US007963280B2

(12) United States Patent
Maeda

(10) Patent No.: US 7,963,280 B2
(45) Date of Patent: Jun. 21, 2011

(54) MAGAZINE FOR AIR GUN HAVING ROTARY CLIP

(75) Inventor: Tetsuo Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 328 days.

(21) Appl. No.: 12/285,973

(22) Filed: Oct. 17, 2008

(65) Prior Publication Data

US 2009/0139507 A1 Jun. 4, 2009

(30) Foreign Application Priority Data

Nov. 30, 2007 (JP) ..... 2007-311142

(51) Int. Cl.
*F41A 9/61* (2006.01)

(52) U.S. Cl. ..... 124/48; 124/45; 124/51.1; 124/52; 124/71; 124/72; 124/82

(58) Field of Classification Search ..... 124/45, 124/48, 51.1, 52, 71, 72, 85
See application file for complete search history.

(56) References Cited

U.S. PATENT DOCUMENTS 2,980,096 A * 4/1961 Merz ..... 124/74
3,227,148 A * 1/1966 Spack ..... 124/76
3,741,189 A * 6/1973 Kester et al. ..... 124/76
3,782,359 A * 1/1974 Kester et al. ..... 124/48
3,818,887 A * 6/1974 Akiyama et al. ..... 124/67
4,422,433 A * 12/1983 Milliman ..... 124/74
4,610,382 A * 9/1986 Ollivier et al. ..... 227/9
4,687,465 A * 8/1987 Prindle et al. ..... 604/61
4,834,058 A * 5/1989 Gegere ..... 124/29
4,848,307 A * 7/1989 Tsao ..... 124/59
4,986,251 A * 1/1991 Lilley ..... 124/67

(Continued)

FOREIGN PATENT DOCUMENTS

DE 20 2005 005 912.9 6/2005

OTHER PUBLICATIONS

Extended European Search Report issued Feb. 25, 2009 for corresponding European Application No. 08 01 7915.

*Primary Examiner* — Gene Kim
*Assistant Examiner* — Alexander R Niconovich
(74) *Attorney, Agent, or Firm* — Rader, Fishman & Grauer PLLC

(57) ABSTRACT

There has been a problem that a projected part of a rear part of a pellet gets stuck with an end side of an attachment wall and rotation is interrupted when a rotary clip moves from a hit pin concave to an end side (i.e., attachment wall) of a magazine main body if the rear end of a pellet in a bore projects from a bore. In order to resolve the problem, there is proposed a magazine main body 1 and a magazine main body 1 having a rotary clip 2 rotatably attached to a rotary clip attachment part 3 of a magazine main body 1 characterized in that a clip opposing wall surface 33 of an attachment wall 34 of a clip opposing wall surface 33 gradually moves away from a cylindrical end surface of opposing rotary clip 2 towards an end side 31 of an attachment wall 34 within a range 35 of a rotational opposing surface positioned between a hit pin concave 32 and a side surface part 10 in the rotational direction of rotary clip 2.

3 Claims, 11 Drawing Sheets

U.S. PATENT DOCUMENTS 5,111,732 A * 5/1992 Marcon et al. ..... 89/135
5,160,795 A * 11/1992 Milliman ..... 42/65
5,285,766 A * 2/1994 Milliman ..... 124/72
5,522,374 A * 6/1996 Clayton ..... 124/59
5,622,160 A * 4/1997 Casas Salva ..... 124/76
5,660,159 A * 8/1997 Clayton ..... 124/66
5,704,150 A * 1/1998 Milliman ..... 42/67
5,724,955 A * 3/1998 Johnson et al. ..... 124/72
5,906,191 A * 5/1999 Wonisch et al. ..... 124/31
6,112,734 A * 9/2000 Kunimoto ..... 124/73
6,470,871 B2 * 10/2002 Casas-Salva ..... 124/48
6,530,368 B1 * 3/2003 Maeda et al. ..... 124/48
6,578,565 B2 * 6/2003 Casas Salva ..... 124/73
6,666,203 B2 * 12/2003 Maeda et al. ..... 124/48
6,688,298 B2 * 2/2004 Maeda et al. ..... 124/48
6,745,755 B2 * 6/2004 Piccini ..... 124/49
6,752,137 B2 * 6/2004 Brunette et al. ..... 124/74
6,796,300 B2 * 9/2004 Petrosyan et al. ..... 124/48
6,915,792 B1 * 7/2005 Sheng ..... 124/48
7,059,316 B1 * 6/2006 Tseng ..... 124/74
7,159,584 B2 * 1/2007 Maeda et al. ..... 124/41.1
7,234,456 B2 * 6/2007 Andresen ..... 124/51.1
7,353,815 B2 * 4/2008 Wei ..... 124/45
7,458,371 B2 * 12/2008 Ong et al. ..... 124/65
7,669,588 B2 * 3/2010 Maeda ..... 124/74
7,765,997 B2 * 8/2010 Klockener et al. ..... 124/48
2003/0075160 A1 * 4/2003 Petrosyan et al. ..... 124/45
2003/0188729 A1 * 10/2003 Maeda et al. ..... 124/45
2003/0188730 A1 * 10/2003 Maeda et al. ..... 124/48
2004/0237952 A1 * 12/2004 Maeda et al. ..... 124/56
2006/0042613 A1 * 3/2006 Hu ..... 124/48
2008/0257327 A1 * 10/2008 Monks ..... 124/48
2009/0056690 A1 * 3/2009 Maeda ..... 124/51.1
2009/0056692 A1 * 3/2009 Maeda ..... 124/63

* cited by examiner

MAGAZINE FOR AIR GUN HAVING ROTARY CLIP

BACKGROUND OF THE INVENTION

1. Field of the Invention

This invention relates to a magazine of an air gun (air pistol), and more specifically relates to a magazine of air gun with a rotary clip (rotary magazine).

2. Description of the Related Art

A magazine of an air gun consists of a substantially rectangular magazine main body with a rotary clip which is a magazine part at either one end or at both ends. This magazine main body is inserted into and attached to a magazine retention part which is a cavity of the air gun main body.

FIGS. 16 through 23, which are fragmentary views, show a conventional magazine main body 100 having a clip rotational axis 101 to which a rotary clip 200 is rotatably attached, and a rotary clip attachment part 105 having an attachment wall 103 including a opposing wall 102 on which the clip rotational axis 101 is provided, formed on at least one end. A hit pin concave part 104 is formed on an upper and lower end of the rotary clip attachment part 105.

The rotary clip 200 has a column-shaped outer shape, a rotational axis hole at the center and multiple bores 201 into which surrounding bullets are loaded, and is rotatably attached in one rotational direction on a clip rotational axis 101 of the rotary clip attachment part 105. Each bore 201 has the shape of hollow cylinder with an internal diameter larger than a diameter of a pellet W.

The rotary clip 200 is placed on the clip rotational axis 101, and is rotated by a clip rotation mechanism or manually at the same time when a bullet is projected. A circular end surface 202 of the cylindrical rotary clip rotates closely facing the clip opposing wall 102.

In general, the rotary clip 200 has 6 to 8 bores 201. Normally, bullets are fired one by one with all bores 201 loaded. The rotary clip 200 has some styles of rotation. One embodiment is that the rotary clip 200 starts rotating when a trigger starts to be pulled and the rotation stops when the trigger is pulled completely. A bullet to be fired moves to a position to fire the bullet, gas is injected immediately and the bullet is fired. In another embodiment, after a bullet is fired, the rotary clip is rotated automatically by a clip rotational mechanism or manually. At the same time, the next bullet is placed at a firing position.

When all bullets loaded in a rotary clip have been fired, the magazine main body is removed from the magazine retention part. A shooter manually loads bullets such as pellets into each vacant bore of the rotary clip while rotating the rotary clip of the removed magazine. Then, the magazine main body is inserted into the magazine retention part.

The magazine with each bore of the rotary clip loaded with a bullet, especially with pellets loaded, is attached to the magazine retention part. However, when pellets are not completely inserted into the bore or the rear end of the pellet W projects from the end surface of the hollow tube of the bore 201 (refer to FIG. 22) when the magazine is attached to the magazine retention part, if the rotary clip 200 is rotated, for the conventional magazines, as shown in FIGS. 20 to 22, the pellet W in the bore 201 moves from a hit pin concave part 104 to the attachment wall 103 of the magazine main body 100, the projecting rear part of the pellet W gets stuck with the end side of the attachment wall 103, and the magazine cannot rotate (refer to FIGS. 20 through 23) which is a problem.

Additionally, when the magazine main body is removed from the magazine retention part and a shooter loads a pellet into each bore and rotates the magazine by one bore after loading a pellet into a bore, in the same manner, if a pellet projects from the hollow tubular end surface of the bore, the projecting pellet gets stuck with the end side of the attachment wall of the magazine main body and the rotary clip does not rotate, which is also a problem.

SUMMARY OF THE INVENTION

In order to solve the above-described problems, there is provided a magazine main body having a rotary clip rotatably attached to either one end or both ends of the magazine main body, wherein the rotary clip is characterized in that the clip opposing wall gradually departs from the tubular end surface of the opposing rotary clip and approaches an upper end of the attachment wall within the range where the clip opposing wall of the clip attachment wall of the rotary clip attachment part is positioned between the hit pin concave part and the side surface part situated in the rotational direction of the rotary clip.

Additionally, there is also proposed a magazine of an air gun having a rotary clip mentioned in paragraph 0010 in which the attachment wall of the rotary clip attachment part is notched within the range from the hit pin concave part to the side surface part in the rotational direction of the rotary clip and within the range from the upper end side and the grip rotational axis to form the notch part.

Further, there is also proposed a magazine of an air gun with a rotary clip mentioned in paragraph 0010 or 0011, characterized in that the thickness of the attachment wall becomes gradually thinner towards the upper end side within the range where the attachment wall of the rotary clip attachment part is situated between the hit pin concave part and the side surface part in the direction of the rotational direction of the rotary clip.

According to the present invention, as in the conventional air guns, when bullets, especially pellets, are loaded into the bores, and the rotary clip is rotated while attached to the air gun main body, and even if the rear end of the pellets in the bores project from the tube of the bores when the rotary clip is loaded manually, the rotation does not stop because the clip opposing face of the attachment wall of the rotary clip attachment part gradually separates from the circular end surface of the opposing rotary clip towards the end side of the attachment wall, and, in a range from the clip rotational axis to the upper end part near the clip rotational axis, from a column end surface of a facing rotary clip in a direction towards an attachment wall peripheral end side, and the projected end part smoothly contacts the inner surface and is pressed into a bore if the projected end part is within the separation distance.

Therefore, for an air gun using a magazine according to the present invention, occurrence of stopped rotation is reduced when the rotary clip rotates, and the air gun is used without problems, thus improving usability for users.

The failure rate of an air gun can be reduced because accidents where a rotary clip or a mechanism for rotating a rotary clip are damaged because a trigger is pulled forcedly when the rotary clip does not rotate can be prevented.

DESCRIPTION OF THE PREFERRED EMBODIMENTS

Figure 11:
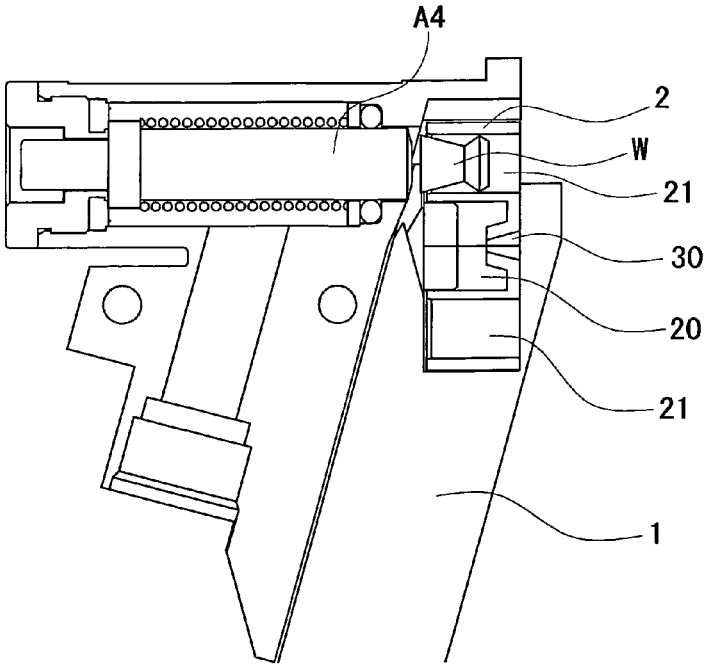
FIG. 11 is an explanation drawing showing layout of hit pin, etc. showing the same.
Figure 12:
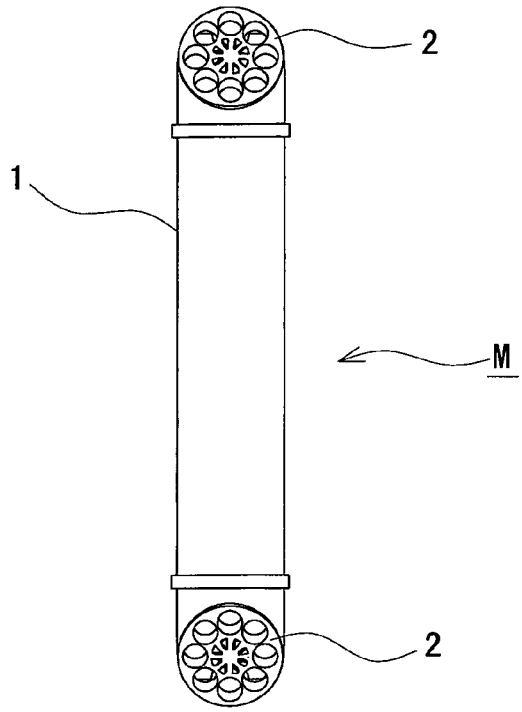
FIG. 12 is a front view of a magazine according to the present invention.
Figure 13:
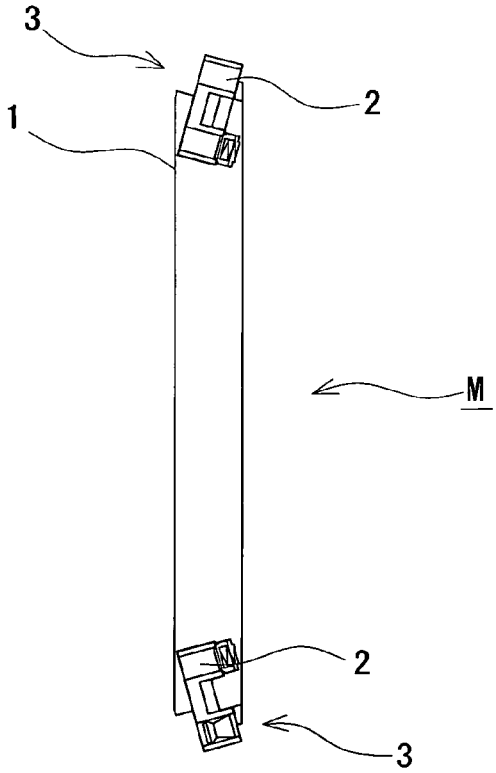
FIG. 13 is a right side view showing the same.
Figure 14:
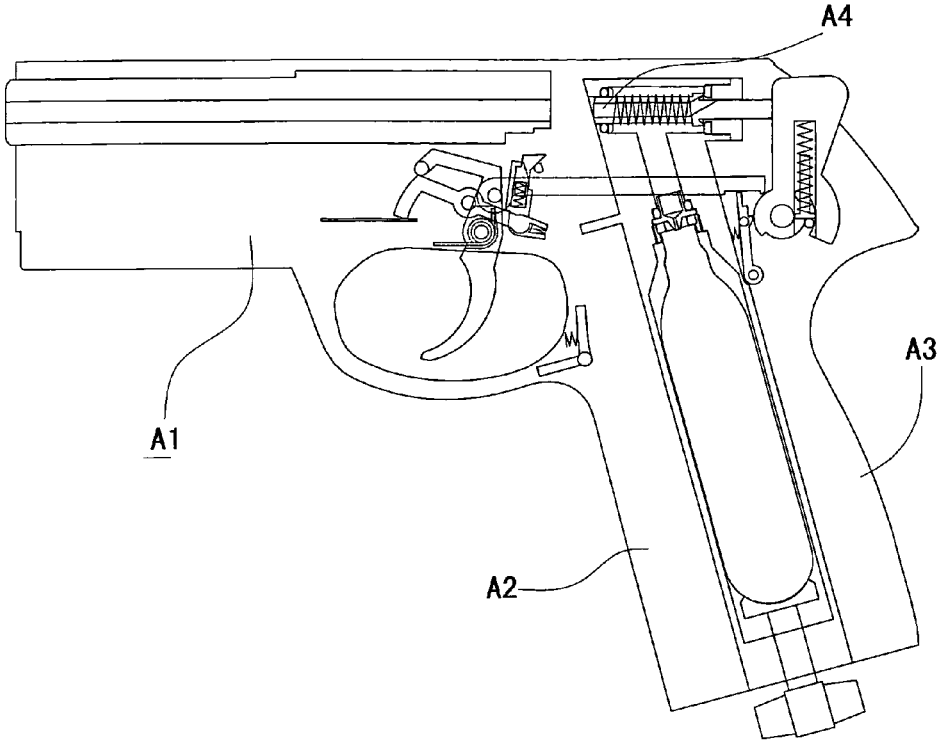
FIG. 14 is an explanatory drawing of an air gun to which a magazine is attached.
Figure 15:
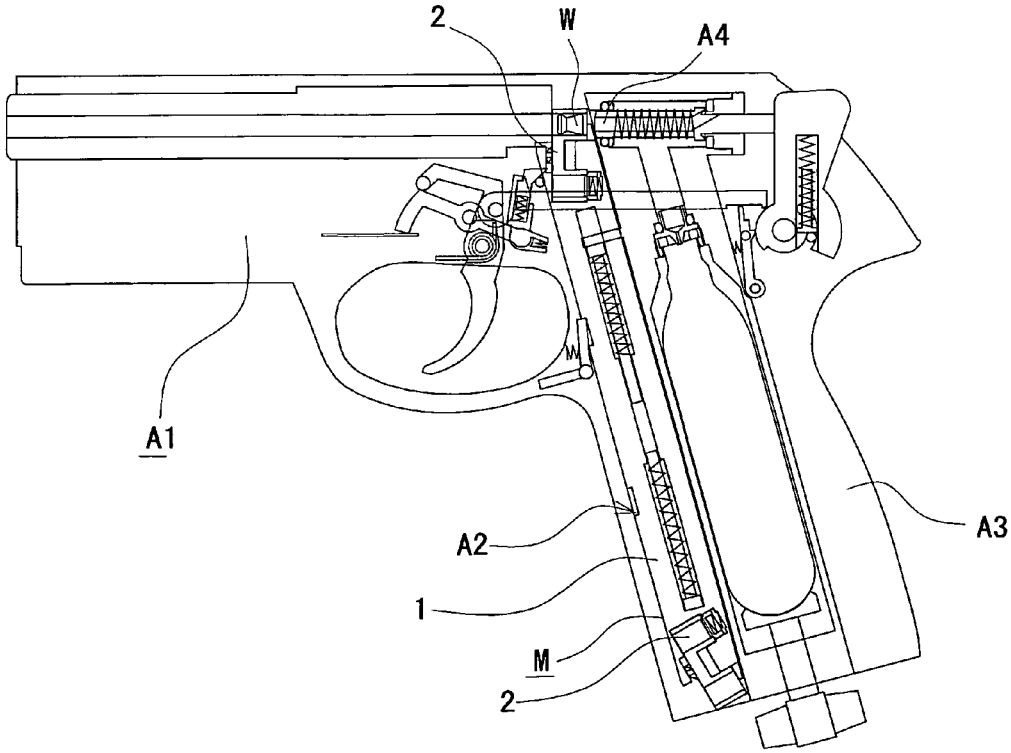
FIG. 15 is an explanatory drawing of an air gun with a magazine attached to the air gun main body.
Figure 16:
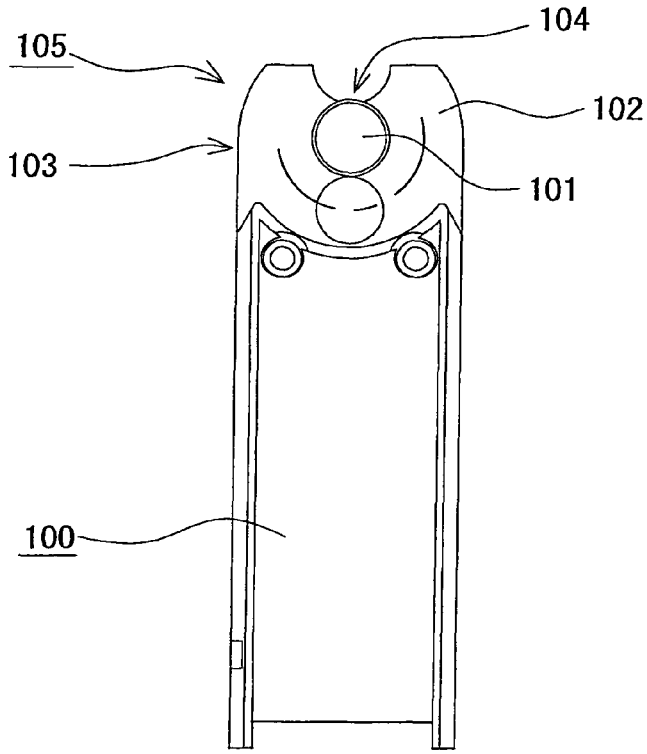
Fig. 16 PRIOR ART
FIG. 16 is a front view of a fragmentary view showing the longer direction half of a magazine main body of an air gun having a rotary clip according to the related art.
Figure 17:
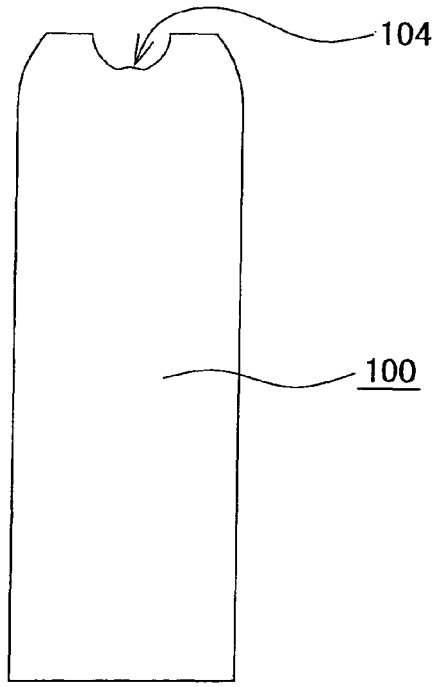
Fig. 17 PRIOR ART
FIG. 17 is a back view of FIG. 16 showing the same.
Figure 18:
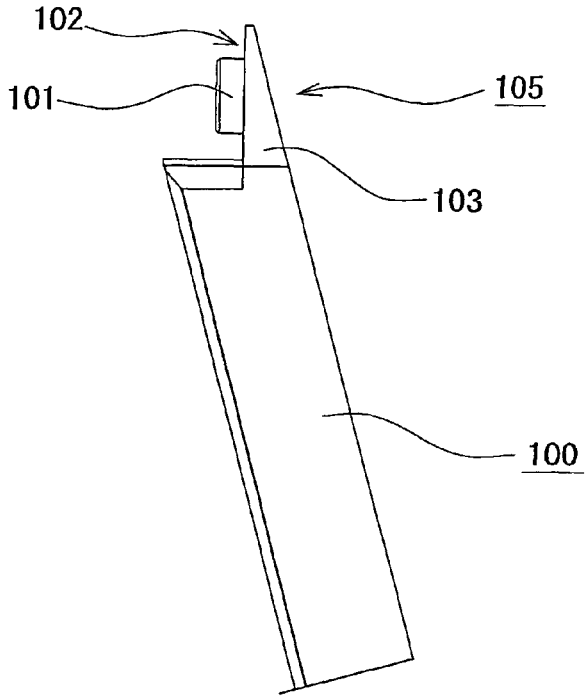
Fig. 18 PRIOR ART
FIG. 18 is a right side view of FIG. 16 showing the same.
Figure 19:
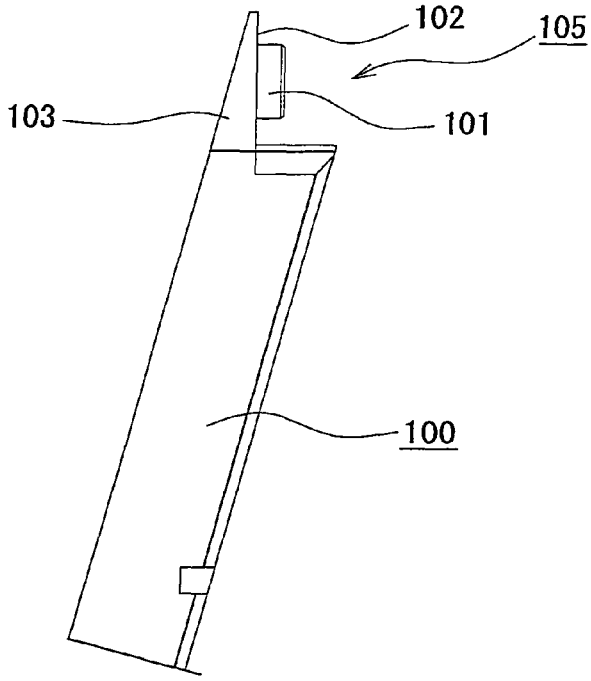
fig. 19 PRIOR ART
FIG. 19 is a left side view of FIG. 16 showing the same.
Figure 20:
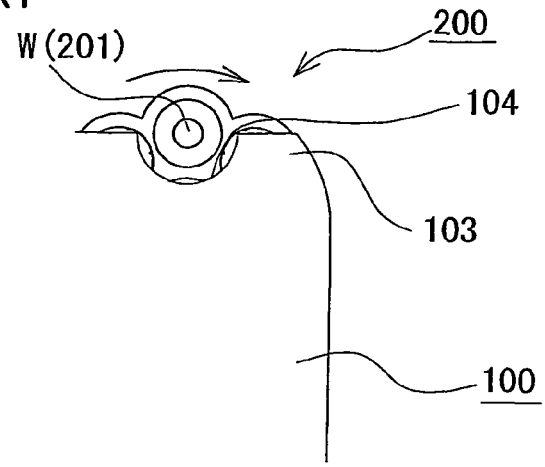
Fig. 20 PRIOR ART
FIG. 20 is a fragmentary back view showing actions of a related art for the same.
Figure 21:
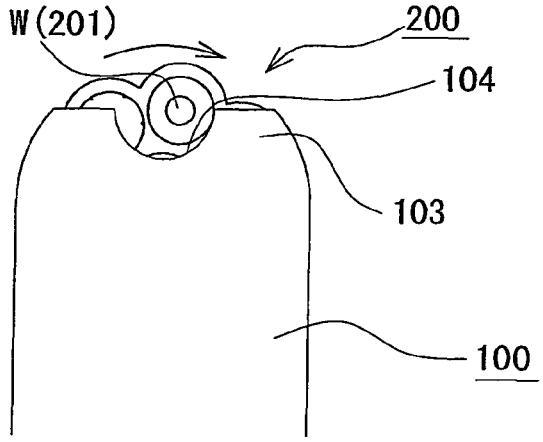
Fig. 21 PRIOR ART
FIG. 21 is a fragmentary back view showing actions of a related art for the same.
Figure 22:
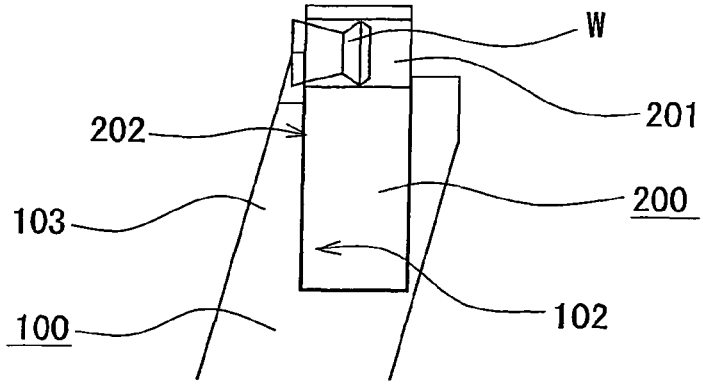
Fig. 22 PRIOR ART
FIG. 22 is a fragmentary left side view showing actions of a related for the same.
Figure 23:
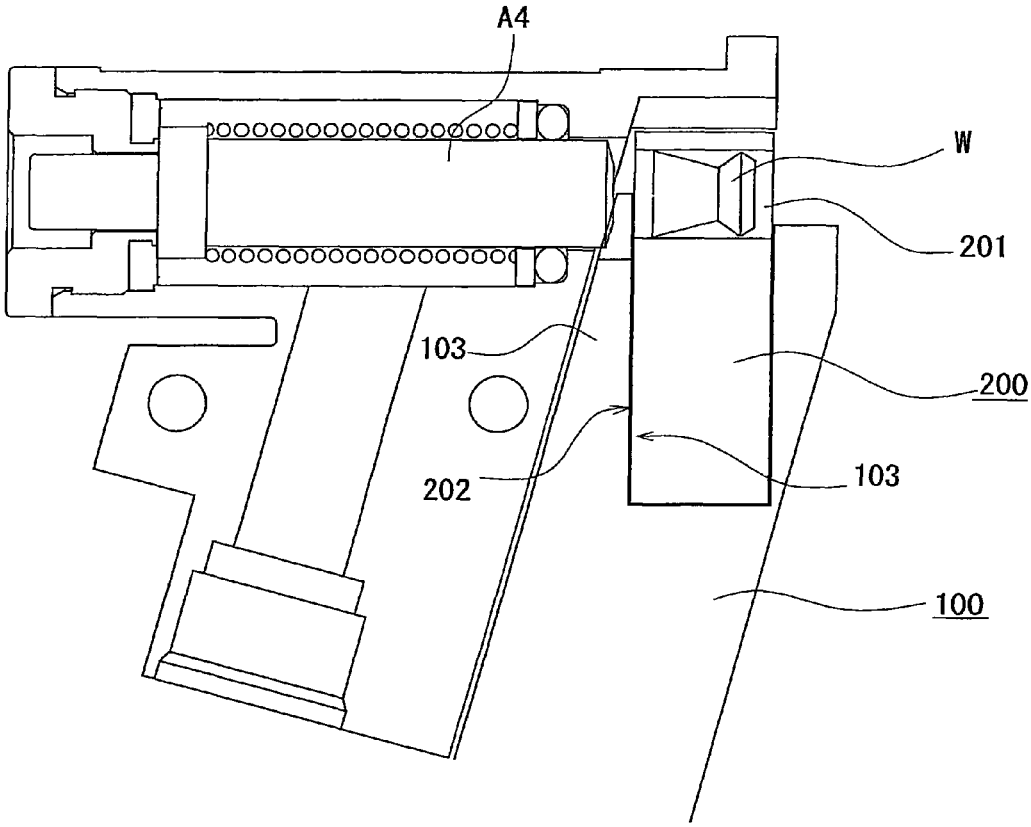
Fig. 23 PRIOR ART
FIG. 23 is an explanatory view showing the layout of hit pin, etc. according to the related art.

A magazine of an air gun having a rotary clip according to an embodiment of the present invention will now be described referring to FIGS. 1 to 4 showing the longer direction half of a magazine main body according to the first embodiment of the present invention, FIGS. 5 to 8 showing the longer direction half of a magazine main body according to the second embodiment of the present invention, FIG. 9 which is a fragmentary back view showing actions of the same according to an embodiment of the present invention, FIG. 10 which is a left side view of the same, FIG. 11 which is an explanatory view showing the layout of the hit pin, etc., FIG. 12 showing the front of a magazine according to the present invention, FIG. 13 showing the right side view of the same, FIG. 14 which is an explanatory view of an air gun to which a magazine is attached and FIG. 15 which is an explanatory view of an air gun to which an magazine is attached.

First, a composition common to the first embodiment and the second embodiment of the magazine M having a rotary clip according to the present invention will be described. The magazine M has a magazine main body 1 which can be attached to a magazine retention part A2 which is a cavity equipped in a grip A3 of an air gun main body A1 and a rotary clip 2 which is rotatably installed in the magazine main body 1.

The magazine main body 1 is a rectangular box. A rotary clip attachment part 3 is provided at least one end in a longitudinal direction. In this embodiment, the rotary clip attachment part 3 is provided at both ends. A rotary clip 2 is rotatably attached to the rotary clip attachment part 3.

The rotary clip 2 has a cylindrical outer shape. The rotary clip 2 has a rotational axis hole 20 at the center and multiple bores 20 around the axis (eight bore according to this embodiment). The rotary clip 2 is rotatably attached to the clip rotational axis 30 by a rotational axis hole 20. The rotary clip 2 rotates while a circular end surface of the cylindrical rotary clip 2 comes close to and faces the clip opposing surface 33 of the rotary clip attachment part 3.

Each rotary clip attachment part 3 comprises the clip rotational axis 30 on which the rotary clip is rotatably installed, the hit pin concave part 32 formed on the upper end side 31 which faces upward when the magazine main body 1 is attached to the air gun main body A, the clip attachment wall 34 including the clip opposing surface 33 and a notch part 36. Within a range 35 of the rotational opposing surface where the clip opposing wall surface 33 of the clip attachment wall 34 of the rotary clip attachment part 3 is positioned from the hit pin concave part 32 to the side part 10 (left side of the magazine main body 1 according to this embodiment) in the rotational direction of the rotary clip 2, rotary clip attachment part 3 has the clip opposing wall surface 33 gradually moving away from the cylindrical end surface of the facing rotary clip 2 towards the end side of the clip attachment wall 34.

In the first embodiment from FIGS. 1 to 4, the clip opposing wall surface 33 gradually departs from the cylindrical end surface of opposing rotary clip 2 towards the end side of the clip attachment wall 34 within the whole range up to the left side part 10 including the range 35 of the rotational opposing surface positioned between the hit pin concave part 32 and the side part 10 (left side of the magazine main body 1 according to this embodiment) in the rotational direction of the rotary clip 2.

In the second embodiment from FIGS. 5 to 8, the clip opposing wall surface 33 gradually moves away from the cylindrical end surface of the opposing rotary clip 2 towards the end side of the clip attachment wall 34 within the range 35 of the rotational opposing surface positioned from the hit pin concave 32 to the side surface part 10 (the left surface of the magazine main body 1 in this embodiment) in the rotational direction of the rotary clip 2. The parallel surface 37 of the side part which does not oppose the cylindrical surface of the rotary clip near the left surface part 10 keeps parallel to the cylindrical end surface of the rotary clip 2.

In the embodiment common to them, the thickness of the attachment wall 34 of the rotary clip attachment part 3 gets gradually thinner closer to the end side within the range 35 of the rotational opposing face positioned between the hit pin concave 32 and a side surface part 10 in the rotational direction of the rotary clip.

Further, in the embodiment from FIGS. 1 to 10, the clip attachment wall 34 of the rotary clip attachment part 3 forms the notch 36 by notching the range from the edge end 31 to the grip rotational axis 30 within the range from the hit pin concave 32 to the side surface part 10 of the rotational direction of the rotary clip 2.

The actions common to the first and second embodiments of the magazine M having a rotary clip according to the present invention will now be described. As shown in FIGS. 14 and 15, the magazine M is inserted from the opening at the lower end of the grip part A3 and attached to the magazine retention part A2 of the air gun main body A1. When the magazine main body 1 is completely inserted into the magazine retention part A2, the hit pin concave 32 which is a concave at the upper end side 31 of the magazine 1 is positioned at the muzzle side of the hit pin A4.

Figure 1:
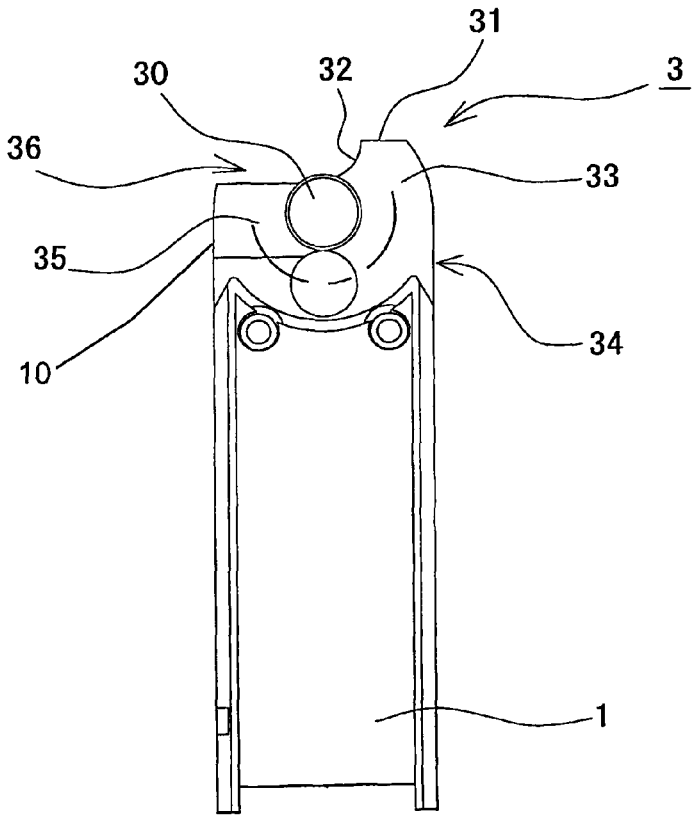
FIG. 1 is a front view of the fragmentary view showing the half of the longer direction of a magazine main body of an air gun having a rotary clip according to the first embodiment of the present invention.
Figure 2:
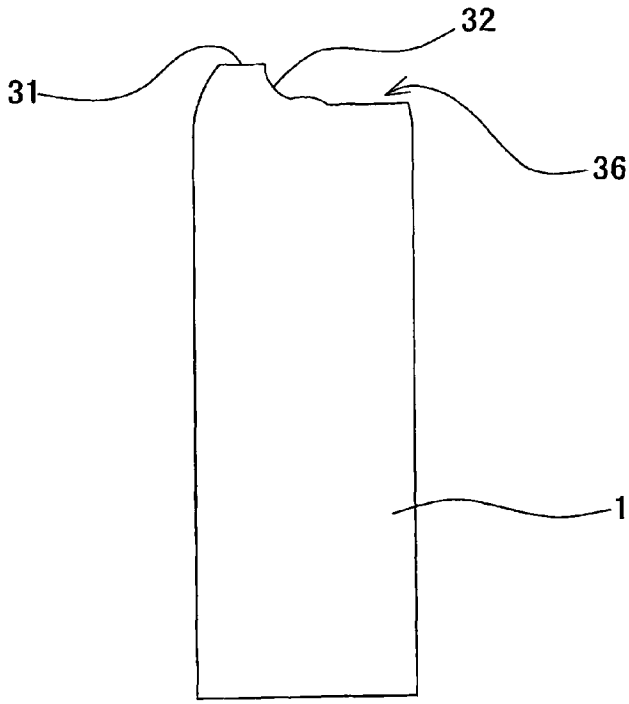
FIG. 2 is a back view of FIG. 1 showing the same.
Figure 3:
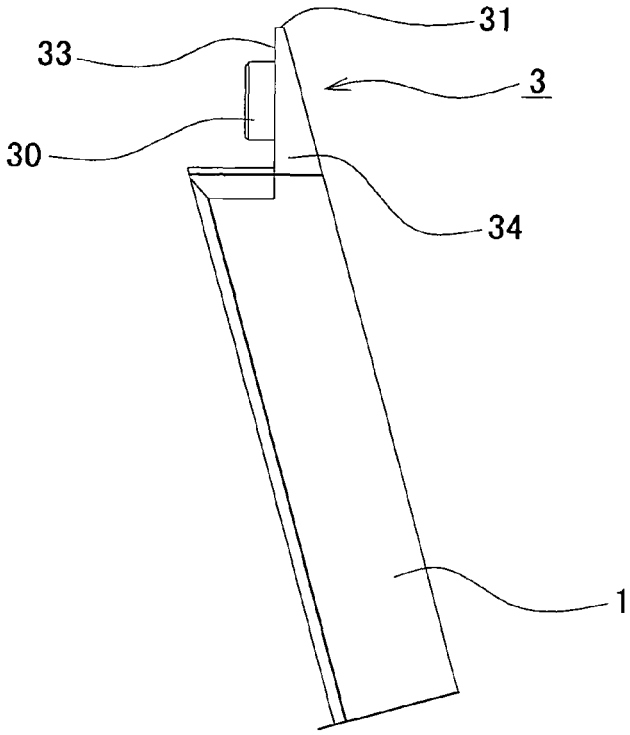
FIG. 3 is a right side view of FIG. 1 showing the same.
Figure 4:
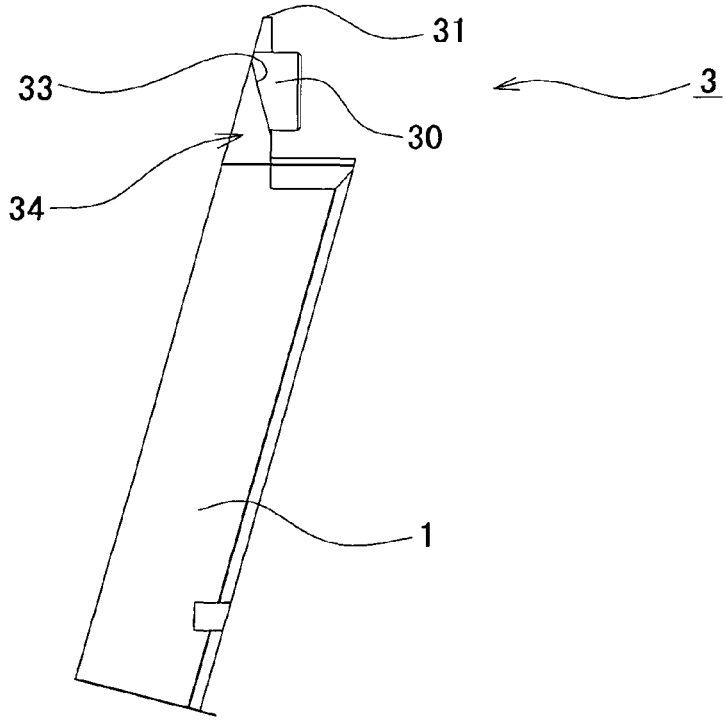
FIG. 4 is a left side view of FIG. 1 showing the same.
Figure 5:
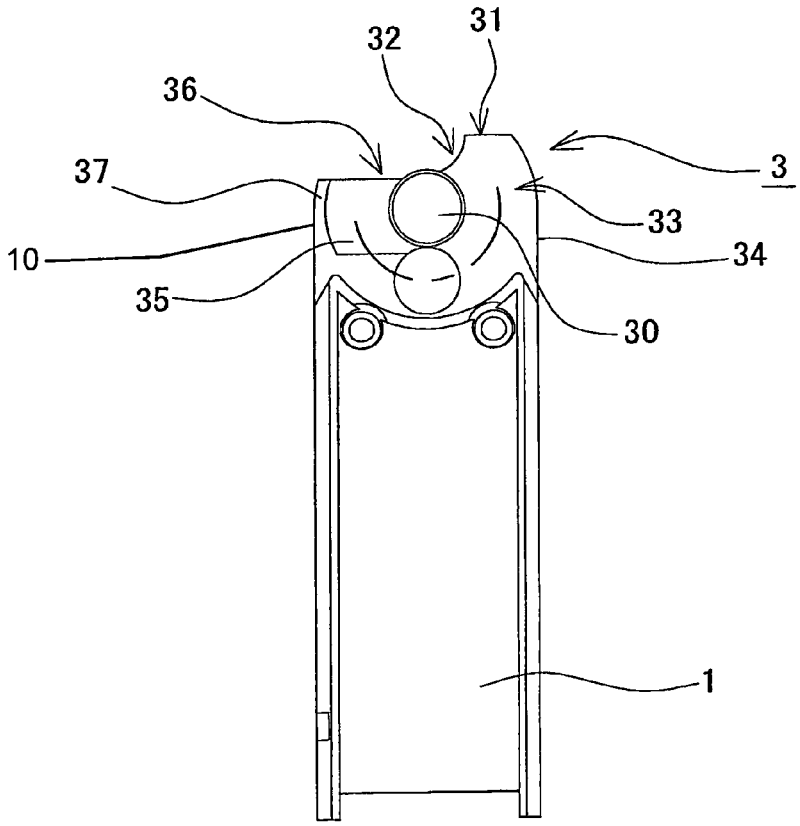
FIG. 5 is a front view of the fragmentary view showing the longer direction half of a magazine main body of an air gun having a rotary clip according to the second embodiment of the present invention.
Figure 6:
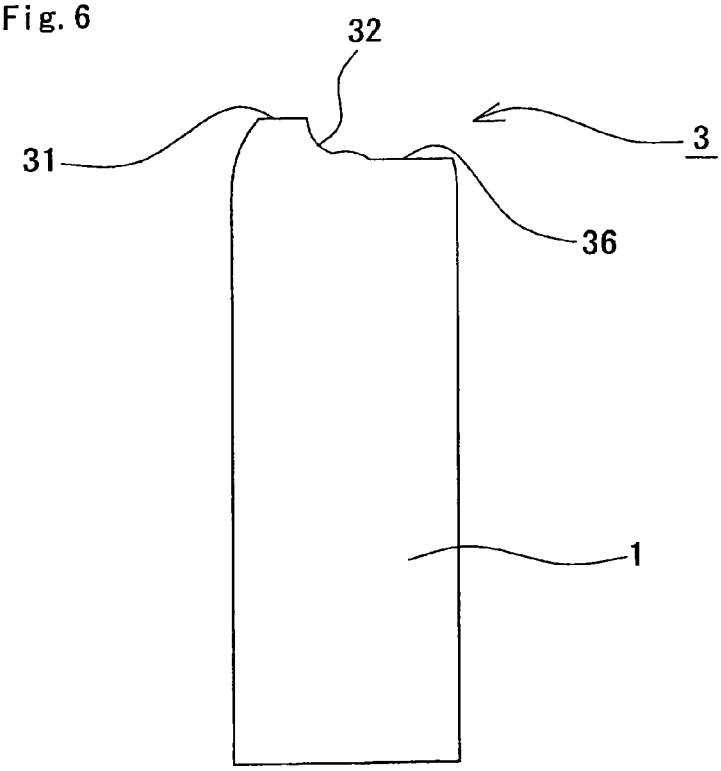
FIG. 6 is the back view of FIG. 5 showing the same.
Figure 7:
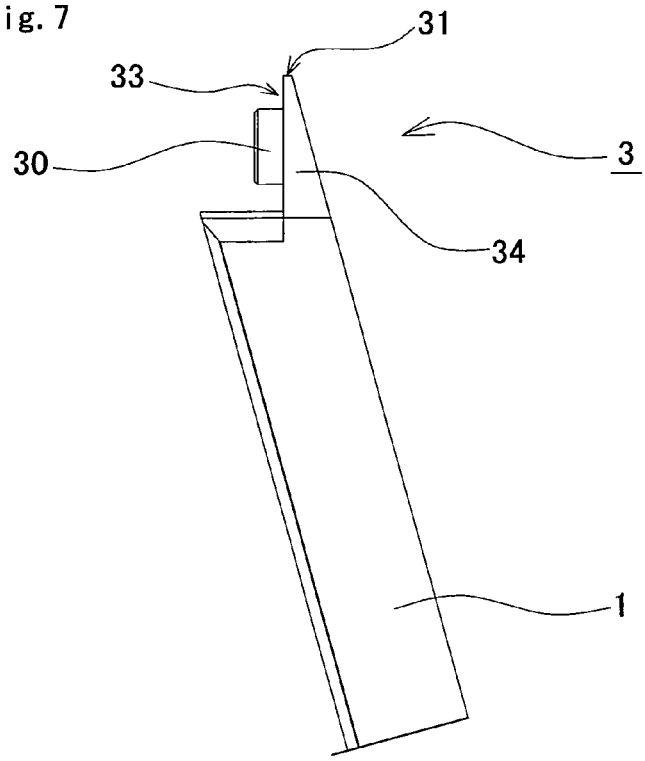
FIG. 7 is a right side view of FIG. 5 showing the same.
Figure 8:
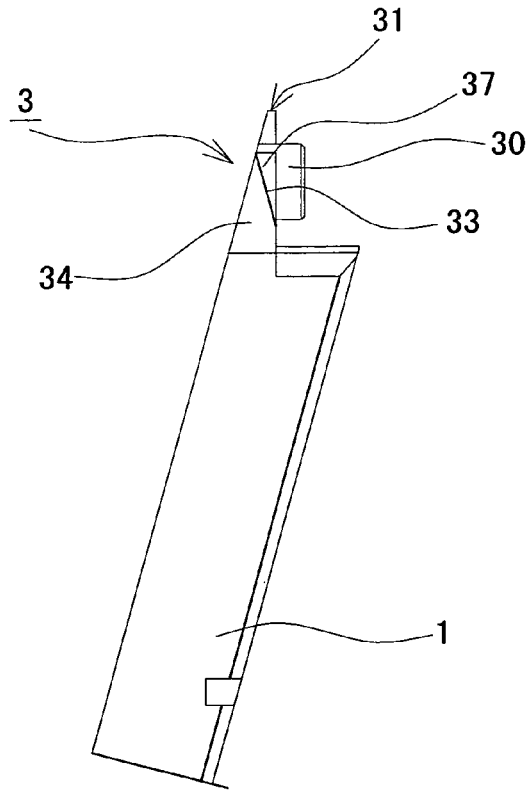
FIG. 8 is a left side view of FIG. 5 showing the same.
Figure 9:
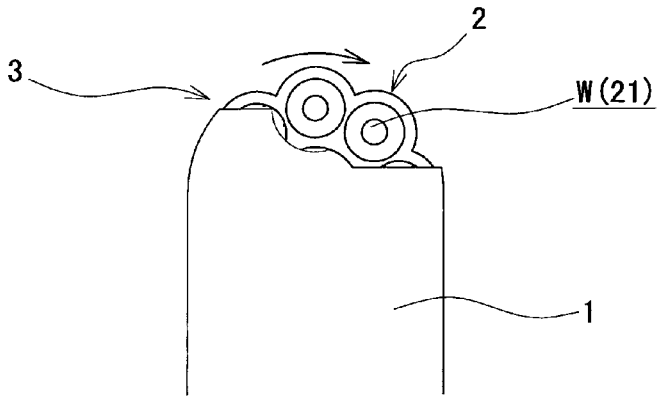
FIG. 9 is a fragmentary back view showing actions of an embodiment of the present invention showing the same.
Figure 10:
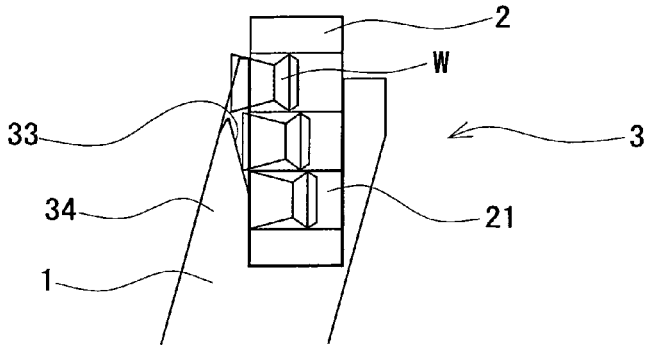
FIG. 10 is a fragmentary left view showing actions of an embodiment of the present invention showing the same.

At this time, as shown in FIGS. 9 and 10, when the rotary clip 2 is rotated in one direction, even if the rear end of a pellet W inserted into the bore 21 projects backward as shown in FIG. 10, the rotation does not stop because the clip opposing surface 33 departs from the cylindrical end surface of the opposing rotary clip 2 towards the end side of the clip attachment wall 34 within the whole range up to the left side part 10 including the range 35 of the rotational opposing surface positioned between the hit pin concave 32 and the side surface part 10 in the rotational direction of the rotary clip 2, and the rear end of the pellet W is inserted into the bore 21 along the clip opposing wall 33 without getting stuck with the clip attachment wall 34.

Further, a pellet W is less prone to getting stuck with the clip attachment wall 34 when the attachment wall 34 of the rotary clip attachment part 3 is notched within the range from the hit pin concave 32 to the side surface part 10 of the rotational direction of the rotary clip 1 and within the range from upper end side 31 to the grip rotational axis 30 to form a notch 36.

The present invention is applicable to an air gun used for competitions, etc.

What is claimed is:

1. A magazine of an air gun having a first end and a second end disposed opposite of the first end, the magazine comprising:

a rotary clip attachment part positioned adjacent a selected one of the first end or the second end of the magazine; and a rotary clip rotatably connected to the rotary clip attachment part and having a rotary clip cylindrical end surface, wherein the rotary clip attachment part has a rotary clip attachment wall defining a rotary clip wall surface facially opposing the rotary clip cylindrical end surface such that at least a portion of the rotary clip wall surface gradually moves away from the rotary clip cylindrical end surface in an inclined manner and in a direction of the selected one of the first and second ends.

2. The magazine of claim 1 wherein the rotary clip attachment wall includes a hit pin concave defining, in part, a notch.

3. The magazine of claim 1 or 2, wherein the rotary clip attachment wall becomes gradually thinner as the rotary clip wall surface gradually moves away from the rotary clip cylindrical end surface.

* * * * *